US007267873B2

(12) United States Patent
Pilakoutas et al.

(10) Patent No.: US 7,267,873 B2
(45) Date of Patent: Sep. 11, 2007

(54) FIBER REINFORCED CONCRETE

(76) Inventors: Kypros Pilakoutas, 51 Kingfield Road, Sheffield (GB) S11 6AU; Peter Waldron, Low Coppice, Farm, Bell Hagg, Sheffield (GB) S10 5PX ( * ) Notice: Subject to any disclaimer, the term of this patent is extended or adjusted under 35 U.S.C. 154(b) by 0 days.

(21) Appl. No.: 10/499,995

(22) PCT Filed: Dec. 20, 2002

(86) PCT No.: PCT/GB02/05827

§ 371 (c)(1),
(2), (4) Date: Jun. 23, 2004

(87) PCT Pub. No.: WO03/056112

PCT Pub. Date: Jul. 10, 2003

(65) Prior Publication Data

US 2005/0129931 A1 Jun. 16, 2005

(30) Foreign Application Priority Data

Dec. 24, 2002 (GB) ..... 0130852.7

(51) Int. Cl.
*D02G 3/00* (2006.01)
*C04B 14/48* (2006.01)

(52) U.S. Cl. ..... 428/379; 428/378; 428/401; 106/644

(58) Field of Classification Search ..... 428/36.92, 428/373, 401
See application file for complete search history.

(56) References Cited

U.S. PATENT DOCUMENTS

| | | | |
|---|---|---|---|
| 4,298,660 | A | 11/1981 | Nakagawa |
| 4,804,585 | A | 2/1989 | Tani |
| 4,960,649 | A | 10/1990 | Takata |
| 5,451,471 | A | 9/1995 | Over |
| 6,693,265 | B1 | 2/2004 | Bell |

FOREIGN PATENT DOCUMENTS

| | | |
|---|---|---|
| BE | A-1003656 | 5/1992 |
| DE | A-1941223 | 2/1971 |
| DE | 3024648 | 1/1982 |
| DE | A-3347675 | 10/1985 |
| DE | A-3435850 | 4/1986 |
| DE | A-3923971 | 3/1991 |
| DE | A-4104929 | 8/1992 |
| DE | A-4315270 | 11/1993 |
| DE | A-4242150 | 6/1994 |
| DE | A-19835075 | 2/2000 |
| EP | A-105385 | 4/1984 |
| EP | 130191 | 7/1984 |
| EP | 0861948 A1 * | 2/1997 |

(Continued)

*Primary Examiner*—Jill Gray
(74) *Attorney, Agent, or Firm*—Keeling Patents & Trademarks, LLC

(57) ABSTRACT

Fiber reinforced concrete has thin steel wire of diameter between 0.05 and 0.3 mm such as cut from recycled vehicle tires. To avoid the problem of balling when mixing, two alternatives are suggested. The first consists of strands of fiber, which demonstrate excellent bond characteristics. The second consists of a mixture of fiber lengths and thicknesses, giving a wide distribution of l/d ratios not exceeding 250, which has the effect of reducing balling tendency so that significant densities can be achieved.

29 Claims, 4 Drawing Sheets

FOREIGN PATENT DOCUMENTS

| | | | |
|---|---|---|---|
| EP | A-861948 | | 9/1998 |
| FR | 1366610 | | 7/1964 |
| FR | 2314156 | | 1/1977 |
| JP | 1153563 | * | 6/1989 |
| NL | A-7108533 | | 12/1972 |
| WO | WO84/02732 | | 7/1984 |
| WO | WO 00/49211 | * | 2/2000 |
| WO | WO00/94211 | | 8/2000 |
| WO | WO-A-01/03473 | | 1/2001 |

* cited by examiner

FIBER REINFORCED CONCRETE

The present invention is in the field of fiber reinforced concrete.

It is known to reinforce concrete using steel cages of welded rods, or indeed individual rods tied together. It is known that these kinds of reinforcements present some problems, primarily because that type of reinforcement is on a "macro" level. Where concrete is required to be locally tough, or the geometrical shape to be reinforced is complex, such reinforcement is not very effective.

It is known to reinforce concrete using fibers, often of steel. Fibers are effective in reinforcing concrete locally, preventing cracking and surface deterioration, as well as providing structural reinforcement.

A problem with such fibers is that, if they are long and rigid (which, with steel, means having a length to diameter (l/d) ratio in excess of about 100, especially when volumes of fibers above 1% are used) then the fibers tend to ball together and prevent even mixing and distribution of them throughout the concrete. Indeed, the more they are mixed, the more they ball together which, thereafter, prevents the concrete from being poured or pumped or cast, as is normally desirable with concrete.

It has been proposed to glue fibers together with water soluble adhesive. By such means, l/d ratios of the individual fibers of as much as 80 can be used even for fiber volumes higher than 2%. This is achieved because, when the bundles of glued fibers are first introduced to the concrete mix, the bundles can be evenly distributed before the moisture in the cement and aggregate mix dissolves the adhesive. At this point the individual fibers separate from the bundle, but they need distribution then only over a local space. Relatively even distribution of the entire stock of fibers is thereby achieved before balling can start to occur.

However, even with this measure, performance is lacking in two key areas.

The first is simple, and this is that if fiber densities approach or exceed 2% by volume, mixing problems become an issue. From the latter perspective, it is more usual not to exceed ½%. Therefore, the reinforcement capacity of the fibers is limited.

The second problem is more complex. To be effective, the fibers must be anchored in the concrete. This is so that strain in the concrete is immediately shared by the reinforcement, "mobilising" the reinforcement to provide tensile support to the concrete to resist its cracking.

Steel presents a relatively "slippery" surface to concrete and, as a general rule, l/d ratios of the order of not less than 100, and ideally about 200 for high strength fibers, are needed to ensure complete mobilisation of the reinforcement. But with l/d ratios not exceeding 50, or at best about 80, such mobilisation cannot fully occur. For similar l/d ratios, smaller diameter fibers are more effective in transmitting loads.

This problem is overcome to some extent by kinking the ends of fibers to form anchors (as disclosed in DE-A-4315270). This means that a crack developing across a fiber, even relatively near one end of the fiber, will transmit load to the fiber. However, the fiber becomes essentially free along its length (at relatively high stresses) within its sleeve of surrounding concrete because there is insufficient area of the fiber on which the concrete can bond. Consequently, the body of the fiber becomes unbonded and the stress is developed over the entire length of the fiber. This means that substantial strain must be imposed before the tension in the fiber balances, and counteracts, the stress in the concrete.

This, in turn, means that a developing crack will widen more before it is halted. More, that is, than if, for example, a much shorter fiber spanned the crack while still being anchored at either end: the extension of such a short fiber would be much less for the same stress than a longer fiber.

Furthermore, using high tensile strength steel adds little benefit because the strength capacity of the fiber is substantially under-utilised. At stresses at which such material would normally yield (that is, exploiting their full strength capability) the fiber would long previously have pulled itself out, even with the anchoring provided by a kinked end.

Consequently, not only can insufficient quantity of reinforcement be employed to provide adequate reinforcement (at least for more significant structural loads) but also the capacity of what is, or could be, employed cannot be fully exploited.

To address this problem many other solutions have been proposed, including modifying the surface of the fiber as in U.S. Pat. No. 5,451,471, DE-A-4242150, U.S. Pat. No. 4,960,649, U.S. Pat. No. 4,804,585, DE-A-3435850 or EP-A-105385, or modifying the cross section of the wire as in DE-A-1941223, U.S. Pat. No. 4,298,660, or even using chains as JP1153563. All of these methods result in expensive reinforcement.

EP-A-861948 suggests thin, high tensile steel wire with anchorages formed across and along its length; The thickness is about 0.08 to 0.3 mm, and the length is from 3 to 30 mm. The tensile strength is about 2000 MPa. Because of the high bonding and high strength, small volumes are adequate to achieve the desired reinforcement (1 to 4% by volume is suggested), which small volumes eliminate mixing problems, at least with l/d ratios below 100. DE-A-3347675 likewise suggests thin wires with surface roughening to improve adhesion to the concrete. Both these arrangements suffer from the expense of the special working of the wire required.

NL-A-7108533 suggests reinforcing concrete material with steel cord of the type used in car tires where the cord comprises several threads wound together with between 50 and 100 twists per meter.

BE-A-1003656 discloses packaging steel reinforcement fibers by gluing with water soluble adhesive, or otherwise temporarily securing, the ends of the fibers to a paper carrier.

It is an object of the present invention therefore to provide a fiber reinforcement structure or composition for concrete that does not suffer from, or at least mitigates the effects of, the aforementioned problems.

In accordance with a first aspect of the present invention there is provided a fiber reinforcement structure for concrete, comprising clean steel fiber of between 0.05 and 0.3 mm diameter, wherein the fibers are stranded together in a strand (or cord) of at least five, and preferably at least twenty, fibers, characterized in that the ends of the fibers in the strand are permanently and structurally secured together, for example by welding.

Preferably, each fiber has an l/d ratio in excess of 150and the strand an l/d ratio of less than 60. Preferably, the strands have a diameter of about 1.55 mm and a length of about 50 mm. There may be at least twenty fibers in each strand. Each strand may comprise an inner core of between 10 and 15 fibers and an outer sleeve of 12 to 20 fibers. The strand preferably comprises an inner core of 12 fibers, and an outer sleeve of 15 fibers. Preferably, there is little or no twist of the majority of the fibers in the strand.

By "clean" is meant less than 5% by volume rubber or other contamination of the fibers and sufficiently grease—and contamination—free to permit bonding of concrete cement to the fibers.

With such thin wire, and such a large l/d ratio, secure bonding of the fibers in the concrete can be assured. This means that cracks open less before the stress is applied to the fiber which, over such a short length of it, tensions rapidly to balance the stress with only a small strain at the concrete crack. Consequently, the crack is not opened much, and so secondary effects such as environmental contaminant or moisture entry are minimised. Since more secure bonding is achieved, higher stresses can be absorbed, thereby more efficiently utilising the full strength capacity of the fiber.

Furthermore, the problem of balling or clumping with the high l/d ratio fibers is overcome by virtue of the stranding of the fibers. When mixing in concrete, the strand behaves as a single fiber having an effective l/d ratio determined by the length and diameter of the strand. In a twenty-fiber strand, for example, this reduces an l/d ratio of 150 of a single fiber to about 30 of the strand. However, because the cement, when hydrated, can penetrate all around the outside fibers and about half way around each of the fibers underneath (ie effectively about fifteen out of twenty in a twenty-fiber strand), the net result is that bonding to the strand is over a much greater surface area. It is up to an order of magnitude greater than bonding to a single fiber (of equivalent l/d ratio of the strand as a whole—ie about 30).

Since the strand can, therefore, have an l/d ratio of as little as 30, clumping is not a problem and so the volume of the reinforcement can be increased to as much as 2% by volume or more. Consequently, not only can more reinforcement be provided, but what reinforcement there is is used to greater efficiency because of the improved bonding of the concrete to the strand.

Indeed, although the improved bonding of the outer fibers of the strand to the concrete causes more instant mobilisation of those fibers to minimise the strain in the concrete, the inner fibers are, to a certain extent, free. At least, they are free intermediate their ends but they are, nevertheless subject to frictional constraint against their neighbors. However, over and above such frictional constraint, should the strain in the concrete develop such that outer fibers of the strand begin to yield, reinforcement remains through the inner fibers which have their full length with which to absorb the strain.

Preferably, there is little or no twist of the majority of the fibers in the strand. Indeed, there may be less than 100 twists of the fibers in the strand per meter. This has the effect of maintaining the axial stiffness of the strand, but it also permits some lateral flexibility, which helps reduce the effect of balling and enables the strand to flex around large aggregate. Preferably, the strands are made by cutting to length cord or wire strands from recycled car and vehicle tires. Preferably said tires have been subject to pyrolysis or anaerobic microwave heating to strip elastomer from the wire strands, without damage to, or leaving much residue left on, the steel. Preferably, said tires have been subject to a process as described in WO-A-01/03473, the entire contents of which are hereby incorporated by reference.

Thus not only can effective reinforcement for concrete be provided, but also it can be got from vast stocks of waste material in the form of old tires. The raw material is therefore almost cost-free, the necessary processing to remove rubber from the strands not causing the cost of the strands to become excessive.

On the other hand, such processing of tires is not completely without cost, and it would be desirable to have fiber-reinforcement, perhaps to a lesser degree, using unwanted steel from tires without such processing.

DE-A-4104929 discloses using wire from tires, but mixes rubber-bound-fiber mixed with non-flammable concrete components, the rubber being burnt off prior to cooling and adding of cement and water. The rubber is left in place during mixing with concrete components to avoid balling problems. It does not appreciate that strands can have a low "macro" l/d ratio and still provide effective bonding to concrete. Consequently, they do not require the protection against balling suggested.

On the whole, tires are presently recycled to a certain extent by repeated shredding, combing, magnetic separation and sifting to release rubber granules which can be employed in numerous applications. However, the steel waste has hitherto defied efficient usage because of the contamination with rubber and textile fiber and is generally baled and deposited in landfill. Some less sensitive furnaces can use the waste as raw steel source, but it is not very cost-effective.

DE-A-3923971 describes a process for mechanically and cryogenically stripping wire "nails" from tires for the purpose of recycling the nails. In the situation that the nails still have rubber connected, they are used as a filler to improve elasticity of the filled material.

Accordingly, in an alternative aspect of the present invention, there; is provided a fiber reinforcement composition for concrete comprising steel fiber obtained by shredding vehicle tires and physically separating therefrom non-steel material until "clean" wire fibers remain, about 90% or more of them being individual fibers and substantially none having an l/d ratio of more than 250, characterised in that a majority of the fibers are less than about 0.5 mm in diameter, any wider diameter fibers having an l/d ratio less than 100.

It is also preferable that a majority of the fibers are about 0.3 mm or less in diameter and have an l/d ratio between 150 and 250. Better still, if more than 80% of the fibers are about 0.3 mm or less in diameter and have an l/d ratio between 150 and 250.

In this aspect, the quantity of fibers being referred to is their number.

It is suggested above that an upper limit of 100 for the l/d ratio of fibers is needed if balling when mixing sufficient amounts of fiber (i.e 2% by volume) is to be avoided. However, when the flexibility of the fiber is high (as it is with steel wire of less and 0.3 mm diameter) it is found that balling can be avoided to a sufficient extent when mixing concrete if the l/d ratio does not exceed 250, and especially if kept below 200. On the other hand, at these lengths, even though there may be a certain contamination that interferes with bonding where it occurs, no surface preparation of the wire, such as suggested in EP-A-861948, is needed to ensure adequate bonding. In addition, the wires of tires having been processed as described are far from straight, so that there is inherent kinking of them, which assists locking of the fiber in the concrete.

Consequently, the essence of the present invention in this second aspect is to avoid as much as possible long, wide-diameter, and therefore stiff, wires, but at the same time maximise long, thin diameter wires. This can be achieved through appropriate mechanical processing of the tires. Thus, the environmentally challenging methods employed in DE-A-4104929 are unnecessary, since essentially only thin wires' are permitted to have longer l/d ratios that guarantee good bonding, but which do not cause balling problems to the same extent as thicker, stiffer wires of the same l/d ratio.

In order to achieve substantially no fibers of l/d ratio above 250, repeated shearing of the fibers is required. However, this has the side effect of also shearing shorter fibers so that even those below 250 may also be sheared. Consequently there needs to be separation of shorter fibers from the mix as they are produced and so that they are not chopped further. This is with the aim of achieving most fibers having an l/d ratio range of between 150 to 250. At the same time longer, wide (that is, stiff) fibers (for example, fibers greater than 0.3 mm in diameter) need to be removed so that they, on the whole do not have an l/d ratio greater than 100.

"Clean" as used in this aspect of the invention has the same meaning as that given to it above. Wire fibers, resulting from such a shredding process, surprisingly provide an effective concrete reinforcement structure. Firstly, despite not providing perfectly clean fibers, a physical shredding process is found to be adequate to achieve sufficient bonding between the fibers and concrete cement, particularly given the l/d ratios suggested. On the other hand, the invention does not specifically exclude further treatment to remove more contamination. Secondly, although the invention requires a minimum quantity of high l/d ratio fiber, it is, in fact, this quantity that determines, and limits, the mixability of the composition or structure. With such long fibers, balling becomes an issue the more long fibers there are. However, it is not found that any less long fibers can be introduced, merely because there is also a proportion of shorter fibers introduced as well. While very short fibers do little to enhance the quality of concrete, short fibers more than a few millimeters long do enhance concrete toughness and wear resistance.

Consequently, it is found that the density of steel that can be added to a concrete mix can be quite reasonable, and in the order of 1 to 4½% by volume of the final mix. Thus, tough fiber-reinforced concrete can be made wherein the reinforcement is used to its maximum extent. That is to say, the long fibers provide strength to the concrete, being highly resistant to pull out under tensile load. On the other hand, the shorter fibers, while not detracting at all from the strength, provide, nevertheless, a substantial part of the toughness of the concrete and its resistance to wear. That toughness is also provided by the long fibers, of course, but the contribution made by the shorter fibers is no less important in this respect. By shorter fibers is meant those having an l/d ratio less than about 150. Thus the long and short fibers each perform complimentary roles in reinforcing concrete, the whole of the reinforcement being greater than merely the sum of their respective contributions.

Such a distribution of wire fibers can be generated by, indeed, is to a certain extent a natural consequence of, repeated shredding and shearing of car or other vehicle tires, and with subsequent magnetic extraction of the wire from the remaining fabric and elastomer. However, care has to be taken that, in shredding and shearing to remove fibers of greater than 250 in l/d ratio, excessive cutting of fibers less than 250 in l/d ratio is minimised. It is desired that the proportion of fibers having l/d ratios in the range 150 to 250 is maximised. At the same time, thicker wires (ie greater than about 0.5 mm in diameter), even those with a large l/d ratio, are most desirably removed and limited to those with no more than about 100 l/d ratio. Indeed, the shorter that thick wires become, the less effective they are as reinforcement, and consequently their entire removal from the composition is preferred.

It is a feature of both aspects of the present invention that they provide outlets for the recycling of vehicle tires, and an inexpensive source of effective reinforcement for concrete.

An important element of the second aspect of the present invention is the mix of the concrete. That is to say, the size distribution and make-up of the aggregate, as well as the type of cement, all have an impact on the tendency of the fiber element to ball when it is mixed. Generally, an increase in fines reduces balling, but it remains that some trial and error might be required to find satisfactory mixes that achieve the aims of the present invention, at least in its second aspect.

In both aspects of the invention, the fibers could be used to produce (a) SIMCON (Slurry Infiltrated Mat Concrete), (b) SIFCON (Slurry Infiltrated Fiber Concrete), and (c) high-strength, high performance concrete.

SIMCON is particularly suited to the second aspect of the present invention, since a very thin mat (similar to glass fiber chopped strand mat) can be used to create thin structural elements of thickness not exceeding a few millimeters. SIMCON is also suitable for near surface reinforcement of thicker elements. The thin mat of fibers can be produced preferably by using polymer adhesives or welding or stitching of the steel fibers.

SIFCON can be produced with both aspects of the present invention, in a much more economic way than with current systems, especially when recycled fibers from tires are used.

For high strength high performance concrete, both aspects can be used simultaneously.

Embodiments of the invention are described hereinafter, by way of example and with reference to the following examples, in which types of concrete are prepared as follows:

EXAMPLE I

A Typical Normal Concrete

| | |
|---|---|
| Total Weight | 100 |
| Ordinary Portland Cement | 16.5 |
| Water | 7.5 |
| Fine Aggregate | 30 |
| Coarse Aggregate (Crushed River Aggregate <20 mm) | 46 |
| Water/Cement ratio | 0.45 |

EXAMPLE II

A High Strength Concrete

| | |
|---|---|
| Total Weight | 100 |
| Ordinary Portland Cement | 15.4 |
| Type of pulverised fuel ash | 4.4 |
| Micro-silica | 4.4 |
| Water | 3.5 |
| Fine Aggregate | 29.7 |
| Coarse Aggregate (Crushed River Aggregate <20 mm) | 42.6 |
| Superplasticizer | 1.5% (Weight of Cement) |
| Water/Cement ratio | 0.23 |

Materials Used

Ordinary Portland Cement

An ordinary portland cement (OPC) type I, manufactured by Rugby Cement Group: in accordance with BS 12: 1996, class 42.5N, was used through the study. The typical chemical and physical properties of the cement are given in Table 1.

Table 1. Chemical and physical properties of the OPC used

TABLE 1

Chemical and physical properties of the OPC used

| Chemical Composition | Percentage | Physical Properties |
|---|---|---|
| Silica $SiO_2$ | 20.5–21.8 | Relative density: 3.1 |
| Alumina $AlO_3$ | 5.1 | Theoretical surface area: 3800 $m^2$/kg |
| Iron $Fe_2O_3$ | 3.7 | pH in water N/A |
| Calcium CaO | 64.6 | Moisture content N/A |
| Magnesium MgO | 1.3 | Comp strength EN 196-1 Mortar Prisms |
| Sulphate $SO_3$ | 2.3–3.1 | 3 days 20.6–21.6 N/$mm^2$ |
| Alkalis | 0.57–0.74 | 7 days 34.8 N/$mm^2$ |
| Chlorides $Cl^-$ | <0.02 | 28 days 42.6–43.4 N/$mm^2$ |

Aggregates

The aggregate used (both coarse and fine) was fluvial dragged gravel. The shape of the aggregate was rounded, fully water-worn or completely shaped by attrition, i.e. river or seashore gravel; desert, seashore and wind-blown sand. The surface texture was smooth, water-worn, or smooth due to fracture of laminated or fine-grained rock, i.e. gravels, chert, slate, marble, some rhyolites. These classifications are made according to BS 812: Part 1:1975. The aggregate grading was made according to the BS 812: Part 1:1975, the results of this grading are shown in the Table 2, and Table 3. Other properties are given in Table 4.

Table 2. Coarse aggregate grading

TABLE 2

Coarse aggregate grading

| Sieve size (mm) | 20 mm aggregate Passing (%) | 10 mm aggregate Passing (%) |
|---|---|---|
| 37.5 | 100 | 100 |
| 20 | 98 | 100 |
| 14 | 57 | 100 |
| 10 | 12 | 95 |
| 5 | 05 | 7 |
| 2.36 | — | 0.65 |

Table 3. Fine aggregate grading

TABLE 3

Fine aggregate grading

| Sieve size (mm) | Fine aggregate sands Passing (%) |
|---|---|
| 9.5 | 100 |
| 4.75 | 98 |
| 2.36 | 88 |
| 1.18 | 80 |
| 0.6 | 68 |
| 0.3 | 23 |

TABLE 3-continued

Fine aggregate grading

| Sieve size (mm) | Fine aggregate sands Passing (%) |
|---|---|
| 0.15 | 4 |
| 0.075 | 0.5 |

Table 4. Other Material Data

TABLE 4

Other Material Data

| | Density | Water Absorption | Water Content |
|---|---|---|---|
| OPC | 3150 | | |
| Sand | 2590 | 0.59 | 0.10 |
| C. Agg. (20) | 2600 | 0.58 | 0.09 |
| C. Agg. (10) | 2600 | 0.60 | 0.34 |

Steel Fibers

Steel Stranded Wires (First Aspect)

The stranded wires used were obtained from the process described in WO-A-01/03473 ("the AMAT process"). The wire was derived primarily from super-single tires. The wires used had an overall average diameter of 1.38 mm. The wire-consisted of an inner core of 12 strands of diameter 0.22 mm, an outer sleeve of another 15 wires of diameter 0.22 mm, and an overwound wire of diameter 0.22 mm at a pitch of 5.33 mm. The wires had traces of carbon black on the surface.

Fibers from Shredded Tyres (Second Aspect)

The fibers used to make the concrete of the second aspect of the present invention were obtained from a shredding process, dealing primarily with a mixture of truck tires. The fibers were not completely free of rubber, having around 3% rubber by weight. The fibers used had the properties described below with reference to FIGS. 8 to 10 in terms of their length (L), thickness (D) and l/d ratio. The strength of the fibers varied from 2000 MPa to 3000 MPa.

The invention is further described hereinafter, by way of example, with, reference to the accompanying drawings, in which:

FIGS. 1*a* and *b* are photos of stranded wire derived from the AMAT process, in FIG. 1*a*, the strands being separated into their individual fibers, whereas in FIG. 1*b* the strands are intact;

Figure 6:
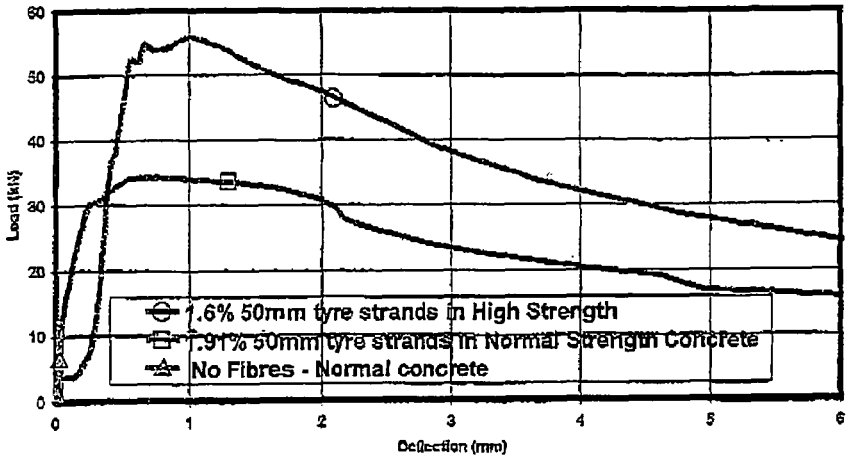
Figure 7:
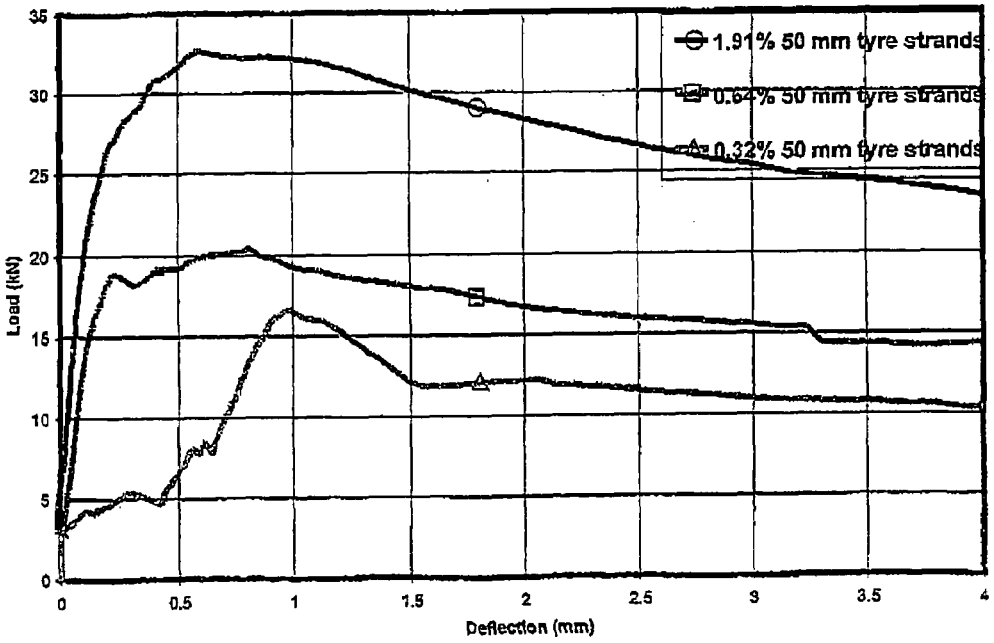
Figure 8:
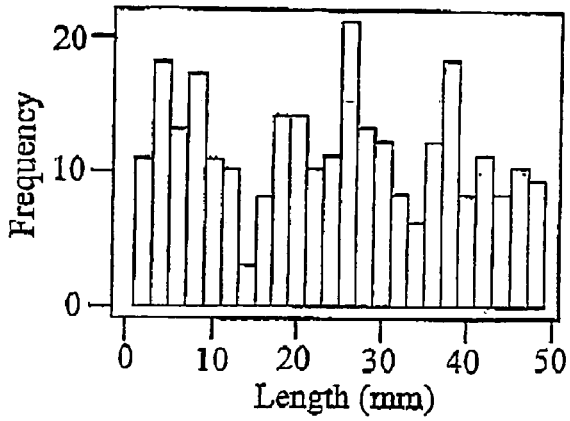
Figure 9:
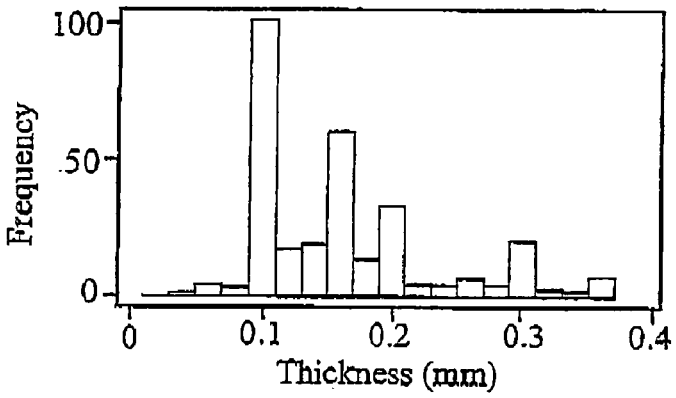
Figure 10:
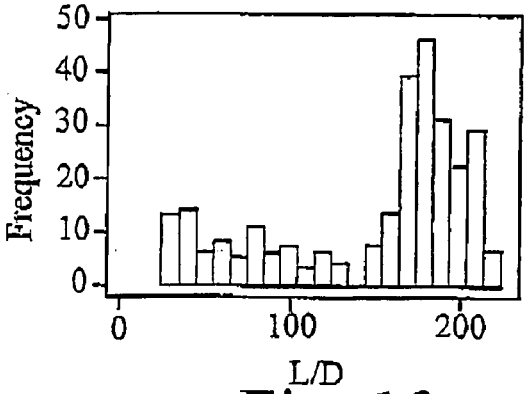

FIG. 6 compares normal concrete with no fibers, normal concrete with tire strands according to the first aspect, and high strength concrete of Example II, with tire strands from the first aspect of the present invention;

FIG. 7 compares increasing density of tire strands in concrete of Example I;

FIG. 8 shows the length distribution of fibers from shredded tires (second aspect);

FIG. 9 shows thickness distribution of fibers in accordance with the second aspect of the present invention; and FIG. 10 shows the length/diameter ratio distribution of fibers according to the second aspect of the present invention.

Figure 1A:
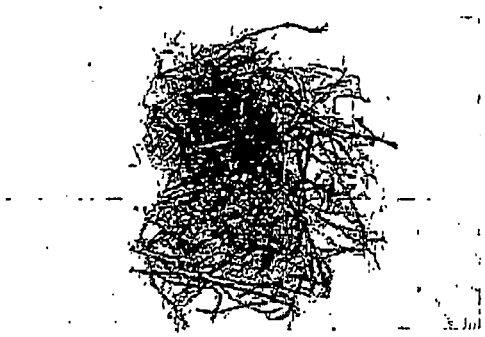
Figure 1B:
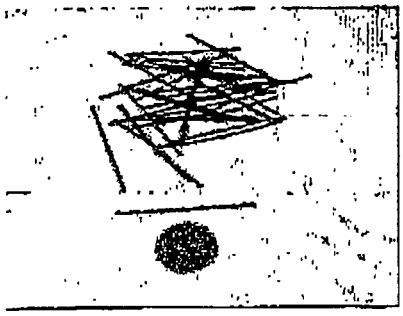
Figure 2:
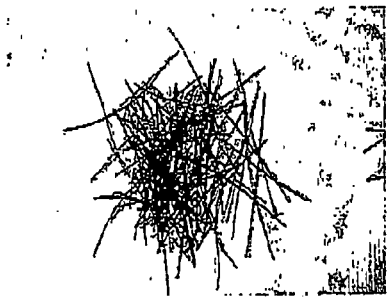
FIG. 2 shows fibers from shredded tires prior to further cleaning and sorting.
Figure 3:
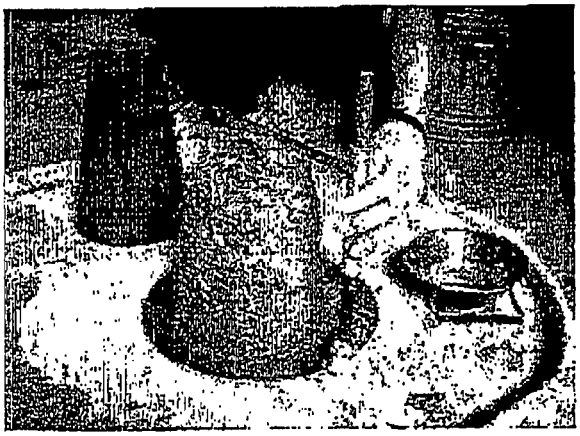
FIG. 3 is a photo of a concrete sample according to Example I above demonstrating adequate workability.

The steel fibers of FIGS. 1 and 2 were prepared as described above and mixed with two examples of concrete mix as also described above, and in various densities (percent by volume) of fiber to concrete, as indicated in FIGS. 4 to 7. To demonstrate workability, the concrete and fiber mix is poured into an open-ended cone, visible in FIG. 3. When the cone is lifted, the slump of the concrete indicates the workability of the concrete and hence its capacity to flow when pumped or poured into the requisite mould. Depending on the degree of workability required, the density of fiber is adjusted accordingly.

Figure 4:
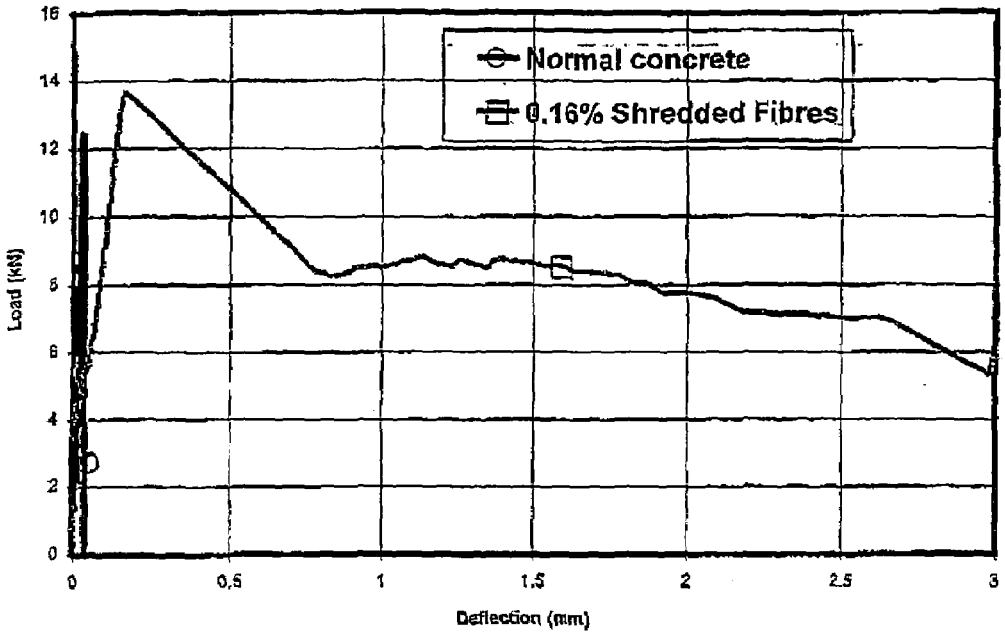
FIG. 4 is a graph showing deflection of a concrete sample according to Example I above with, and without, shredded fibers of the second aspect of the present invention.

With reference to FIGS. 4 to 7, standard concrete blocks are formed and cured and subjected to increasing load while the deflection of the sample is monitored. In FIG. 4, it can be seen that, for normal, unreinforced concrete, load increases with minimal deflection up to a maximum point at which fracture occurs. However, with only 0.16% of shredded fibers, (in accordance with the second aspect of the present invention), substantial deflection of the sample occurs while, still supporting a load.

Figure 5:
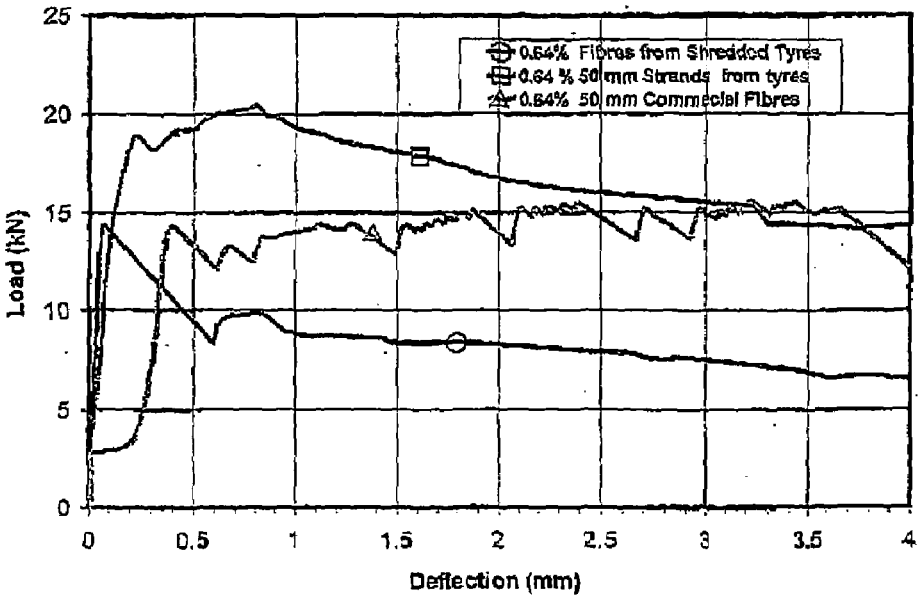
FIG. 5 is a similar graph comparing the first and second aspects of the present invention, in concrete from Example I, and also comparing with the same concrete employing presently available commercial fibers.

In FIG. 5, 0.64% density of fibers were included in three samples of normal concrete in accordance with Example I above. In the first sample, the fibers were in accordance with the second aspect of this invention, namely from shredded tires. In the second sample, the fibers were from a commercially available source (Novocon). The third sample comprised fibers in the form of strands in accordance with the first aspect of the present invention exhibited the greatest loads and defelections, while the sample according to the second aspect demonstrated quite acceptable loads.

FIG. 6 demonstrates the substantial loads that are accommodated with high strength concrete (according to Example II above) compared with normal strength concrete (according to Example I above).

FIG. 7 demonstrates the increasing loads capable of accomodation with increasing density of fiber in accordance with the first aspect of the present invention.

Finally, in FIGS. 8 to 10, it can be seen that the distribution of fibers employed in the examples according to the second aspect of the invention have a wide distribution of lenghts and four main thicknesses. This results in a length to diameter distribution in which the vast majority of the fibers, both in terms of number and volume percent have an l/d ration in excess of 150, and less than 250. The remaining fibers, about 30% in terms of frequency, have l/d ratios between 30 and 150. As mentioned above, while these will contribute less towards the tensile strength of concrete, they will add local toughness and wear resistance.

The invention claimed is:

1. A fiber reinforcement structure for concrete, comprising clean steel fiber of between 0.05 and 0.3 mm diameter, wherein said fibers are stranded together in a cord of at least five said fibers, characterized in that the ends of said fibers in said strand are permanently and structurally secured together, and whereby the fibers remain secured together after dispersion in concrete.

2. A fiber reinforcement structure according to claim 1, in which each said fiber has a length to diameter ratio in excess of 150, and said strand has a length to diameter ratio of less than 60.

3. A fiber reinforcement structure according to claim 1, in which said strands have a diameter of 1.5 mm and a length of 50 mm.

4. A fiber reinforcement structure according to claim 1, in which there are at least twenty said fibers in each said strand.

5. A fiber reinforcement structure according to claim 4, in which said strand comprises an inner core of not less than 10 and not more than 15 said fibers and an outer sleeve of not less than 12 fibers and not more than 20 said fibers.

6. A fiber reinforcement structure according to claim 4, in which said strand comprises an inner core of 12 fibers, and an outer sleeve of 15 fibers.

7. A fiber reinforcement structure according to claim 1, in which said fibers have a diameter of not less than 0.1 mm and not more than 0.2 mm.

8. A fiber reinforcement structure according to claim 1, in which there is less than 100 twists of said fibers in said strand per meter.

9. A fiber reinforcement structure according to claim 1, in which the said ends of said fibers in said strand are secured together by welding.

10. A fiber reinforcement structure according to claim 1, in which said strands are made by cutting to length said wire strands from recycled car and vehicle tires.

11. A fiber reinforcement structure according to claim 10, in which said tires have been subjected to anaerobic heating to strip elastomer from said wire strands.

12. A fiber reinforcement composition for concrete comprising steel fiber obtained by shredding vehicle tires and physically separating therefrom non-steel material until "clean" wire fibers remain, about 90% or more of them being individual fibers and substantially none having an l/d ratio of more than 250, characterized in that a majority of the fibers are less than about 0.5 mm in diameter, any wider diameter fibers having an l/d ratio less than 100.

13. A composition according to claim 12, in which a majority of the fibers are 0.3 mm or less in diameter and have an l/d ratio between 150 and 250.

14. A composition according to claim 12, in which more than 80% of the fibers are 0.3 mm or less in diameter and have an l/d ratio between 150 and 250.

15. A fiber reinforcement structure as claimed in claim 1, in which:

each said fiber has a length to diameter ratio in excess of 150 and said strand has a length to diameter ratio of less than 60, and said strands have a diameter of 1.5 mm and a length of 50 mm.

16. A fiber reinforcement structure as claimed in claim 1, in which:

each said fiber has a length to diameter ratio in excess of 150 and said strand has a length to diameter ratio of less than 60, said strands have a diameter of 1.5 mm and a length of 50 mm, and each said strand contains at least twenty said fibers.

17. A fiber reinforcement structure as claimed in claim 1, in which:

said fiber has a length to diameter ratio in excess of 150 and said strand has a length to diameter ratio of less than 60, said strands have a diameter of 1.5 mm and a length of 50 mm, ach said strand contains at least twenty said fibers, and said strand comprises an inner core of not less than 10 and not more than 15 fibers and an outer sleeve of not less than 12 and not more than 20 fibers.

18. A fiber reinforcement structure as claimed in claim 1, in which:

said fiber has a length to diameter ratio in excess of 150 and said strand a length to diameter ratio of less than 60, said strands have a diameter of 1.5 mm and a length of 50 mm, each said strand contains at least twenty said fibers, and each said strand comprises an inner core of 12 fibers, and an outer sleeve of 15 fibers.

19. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, each said strand comprises an inner core of not less than 10 and not more than 15 fibers, and an outer sleeve of not less than 12 and not more than 20 fibers, and said fibers have a diameter between 0.1 and 0.2 mm.

20. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, said strand contains at least twenty said fibers, each said strand comprises an inner core of 12 fibers, and an outer sleeve of 15 fibers, and said fibers have a diameter between 0.1 and 0.2 mm.

21. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of not less than 10 and not more than 15 fibers, an outer sleeve of not less than 12 and not more than 20 fibers, said fibers have a diameter between 0.1 and 0.2 mm, and there are less than 100 twists of said fibers in said strand per meter.

22. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of 12 fibers, and an outer sleeve of 15 fibers, said fibers have a diameter between 0.1 and 0.2 mm, and there are less than 100 twists of said fibers in said strand per meter.

23. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of not less than 10 and not more than 15 fibers, an outer sleeve of not less than 12 and not more than 20 fibers, said fibers have a diameter between 0.1 and 0.2 mm, there are less than 100 twists of said fibers in said strand per meter, and said ends of said fibers in said strand are secured together by welding.

24. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of 12 fibers, and an outer sleeve of 15 fibers, said fibers have a diameter between 0.1 and 0.2 mm, there are less than 100 twists of said fibers in said strand per meter, and said ends of said fibers in said strand are secured together by welding.

25. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of not less than 10 and not more than 15 fibers, and an outer sleeve of not less than 12 and not more than 20 fibers, said fibers have a diameter between 0.1 and 0.2 mm, there are less than 100 twists of said fibers in said strand per meter, said ends of said fibers in said strand are secured together by welding, and in which said strands are made by cutting to length wire strands from recycled car and vehicle tires.

26. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of 12 fibers, and an outer sleeve of 15 fibers, said fibers have a diameter between 0.1 and 0.2 mm, there are less than 100 twists of said fibers in said strand per meter, said ends of said fibers in said strand are secured together by welding, and in which said strands are made by cutting to length wire strands from recycled car and vehicle tires.

27. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of not less than 10 and not more than 15 fibers, and an outer sleeve of not less than 12 and not more than 20 fibers, said fibers have a diameter between 0.1 and 0.2 mm, there are less than 100 twists of said fibers in said strand per meter, said ends of said fibers in said strand are secured together by welding, and in which said strands are made by cutting to length wire strands from recycled car and vehicle tires, and in which said tires have been subject to anaerobic heating to strip elastomer from the wire strands.

28. A fiber reinforcement structure as claimed in claim 1, in which:

said fiber has a length to diameter ratio in excess of 150, and said strand a length to diameter ratio of less than 60, said strands have a diameter of 1.5 mm and a length of 50 mm, each said strand contains at least twenty said fibers, said strand comprises an inner core of 12 fibers, and an outer sleeve of 15 fibers, said fibers have a diameter between 0.1 and 0.2 mm, there are less than 100 twists of said fibers in said strand per meter, said ends of said fibers in said strand are secured together by welding, and in which said strands are made by cutting to length wire strands from recycled car and vehicle tires, and in which said tires have been subject to anaerobic heating to strip elastomer from the wire strands.

29. A fiber reinforcement structure for concrete, comprising clean steel fiber of between 0.05 and 0.3 mm diameter, wherein said fibers are stranded together in a cord of at least five fibers, characterized in that the ends of said fibers in said strand are permanently and structurally secured together, and whereby the fibers remain secured together after dispersion in concrete, and in which each fiber has a length to diameter ratio in excess of 150, and said strand a length to diameter ratio of less than 60 and in which said strands have a diameter of 1.5 mm and a length of 50 mm and in which said strands have a diameter of 1.5 mm and a length of 50 mm and in which said strand comprises an inner core of 12 fibers, and an outer sleeve of 15 fibers and in which said fibers have a diameter between 0.1 and 0.2 mm and in which there are less than 100 twists of said fibers in said strand per meter and in which the ends of said fibers in said strand are secured together by welding and in which said strands are made by cutting to length wire strands from recycled car and vehicle tires and in which said tires have been subject to anaerobic heating to strip elastomer from the wire strands.

* * * * *